US007902129B2

(12) United States Patent
Allen

(10) Patent No.: US 7,902,129 B2
(45) **Date of Patent: *Mar. 8, 2011**

(54) DELIVERY OF AGENTS TO THE CUTTING MECHANISM OF PAPER SHREDDERS

(75) Inventor: Mark S. Allen, Orem, UT (US)

(73) Assignee: Buttercup Legacy, LLC, Orem, CT (US)

( * ) Notice: Subject to any disclaimer, the term of this patent is extended or adjusted under 35 U.S.C. 154(b) by 1104 days.

This patent is subject to a terminal disclaimer.

(21) Appl. No.: 11/563,616

(22) Filed: Nov. 27, 2006

(65) Prior Publication Data

US 2007/0087942 A1 Apr. 19, 2007

Related U.S. Application Data

(63) Continuation-in-part of application No. 10/925,470, filed on Aug. 25, 2004, now Pat. No. 7,166,561.

(60) Provisional application No. 60/514,154, filed on Oct. 23, 2003, provisional application No. 60/759,733, filed on Jan. 18, 2006.

(51) Int. Cl.

| | |
|---|---|
| ***C10M 109/00*** | (2006.01) |
| ***F01M 9/00*** | (2006.01) |
| ***B02C 18/00*** | (2006.01) |
| ***B65D 77/00*** | (2006.01) |

(52) U.S. Cl. ..... 508/110; 508/100; 184/109; 241/2; 241/15

(58) Field of Classification Search ..... 508/100, 508/110; 184/109; 241/2, 15

See application file for complete search history.

(56) References Cited

U.S. PATENT DOCUMENTS

| | | | |
|---|---|---|---|
| 2,350,366 | A | 6/1944 | Mitchell |
| 3,258,210 | A | 6/1966 | Panning |
| 3,333,752 | A | 8/1967 | Vincens |

(Continued)

FOREIGN PATENT DOCUMENTS

| | | |
|---|---|---|
| DE | 3426979 | 1/1986 |

(Continued)

OTHER PUBLICATIONS

Staples Product Support Center, Staples Brand Product Support, Staples 20-Sheet Cross Cut Shredder, downloaded Oct. 10, 2007, available at http://product-support-staples.com.

(Continued)

*Primary Examiner* — Glenn Caldarola
*Assistant Examiner* — Jim Goloboy
(74) *Attorney, Agent, or Firm* — Workman Nydegger

(57) ABSTRACT

Lubrication substrates are disclosed that have been treated with or that carry a lubricant for maintaining a paper shredder. The lubrication substrate is fed through the shredding mechanism of a paper shredder. Rather than requiring disassembly of the paper shredder, maintenance and lubrication can be performed by passing the lubrication substrate through the shredding mechanism. The lubrication substrates can take any of a variety of forms, and can be substantially rigid and/or stiff. The lubrication substrates can also include scented lubricants and decomposing agents. Paper shredders are also disclosed for use with the lubrication substrates. The paper shredders can have various means for identifying when lubrication is needed and/or when the cutting mechanism of the paper shredder is lubricated by a lubrication sheet. Paper shredders having a reservoir of lubricant for delivery to the cutting mechanism of the paper shredder are also disclosed.

32 Claims, 9 Drawing Sheets

U.S. PATENT DOCUMENTS

| | | | | | |
|---|---|---|---|---|---|
| 3,472,675 | A | * | 10/1969 | Himmel et al. | 428/131 |
| 3,911,579 | A | | 10/1975 | Lane et al. | |
| 4,611,361 | A | | 9/1986 | Shinkai | |
| 4,891,265 | A | | 1/1990 | Samagalsky | |
| 5,105,836 | A | * | 4/1992 | Gentry et al. | 131/359 |
| 5,186,398 | A | | 2/1993 | Vigneaux, Jr. | |
| 5,188,301 | A | | 2/1993 | Hasegawa | |
| 5,250,353 | A | | 10/1993 | Bartholomew et al. | |
| 5,494,229 | A | | 2/1996 | Rokos et al. | |
| 5,698,305 | A | | 12/1997 | Suzuki et al. | |
| 6,079,645 | A | | 6/2000 | Henreckson et al. | |
| 6,123,221 | A | * | 9/2000 | Simpson | 221/33 |
| 6,416,624 | B1 | * | 7/2002 | Nielsen et al. | 162/155 |
| 7,166,561 | B2 | * | 1/2007 | Allen | 508/100 |
| 2005/0218250 | A1 | | 10/2005 | Matlin et al. | |
| 2006/0049291 | A1 | | 3/2006 | Rajewski | |
| 2006/0054724 | A1 | | 3/2006 | Matlin et al. | |
| 2006/0054725 | A1 | | 3/2006 | Matlin | |
| 2006/0138261 | A1 | | 6/2006 | Ho | |
| 2006/0157601 | A1 | | 7/2006 | Matlin et al. | |
| 2006/0169619 | A1 | | 8/2006 | Wang | |
| 2006/0208117 | A1 | | 9/2006 | Castronovo | |
| 2006/0219827 | A1 | | 10/2006 | Matlin et al. | |
| 2006/0243631 | A1 | | 11/2006 | Duke | |
| 2007/0007373 | A1 | | 1/2007 | Matlin et al. | |
| 2007/0075170 | A1 | | 4/2007 | Kim | |
| 2007/0080252 | A1 | | 4/2007 | Pierce et al. | |
| 2007/0221767 | A1 | | 9/2007 | Matlin | |

FOREIGN PATENT DOCUMENTS

| | | | | |
|---|---|---|---|---|
| DE | G87022079 | | | 7/1987 |
| DE | G87022079 | U | * | 7/1987 |
| DE | 29709492 | | | 8/1997 |
| GB | 1502067 | | | 2/1978 |
| GB | 2187238 | | | 1/1986 |
| GB | 2187238 | | | 9/1987 |
| JP | 57-76734 | | | 5/1982 |
| JP | 1299646 | | | 12/1989 |
| JP | 8001023 | | | 1/1996 |
| WO | WO 00/67924 | | | 5/2000 |
| WO | 2006031324 | | | 3/2006 |
| WO | WO 2006/036370 | | | 4/2006 |
| WO | 2006074122 | | | 7/2006 |

OTHER PUBLICATIONS

BPAI Decision dated Aug. 19, 2010.

U.S. Appl. No. 11/177,480 to Tai Matlin entitled "*Shredder Throat Safety System*" filed Jul. 11, 2005.

U.S. Appl. No. 11/385,864 to Tai Matlin entitled "*Shredder With Oiling Mechanism*" filed Mar. 22, 2006.

Lessons Learned Database, *Aerosol Lubricants Can Flash when Sprayed on Energized Shredders*, retrieved from http://www.eh.doe.gov/11/11db/detail.CFM?Lessons_IdentifierIntern=LANL-MATSCCMPLX-2004-0002 on Oct. 24, 2006 (dated Jan. 28, 2004).

Safety Digest de Securite, *Valuable Lessons at Low Cost*, retrieved from http://www.vcds.forces.gc.ca/dsafeg/pubs/digest/6-03/art06_e.asp on Dec. 27, 2006 (Dated Jun. 2003).

*Shredder Maintenance*. Secure Shredders. Printed Feb. 24, 2006, upon information and belief, available at least as early as Aug. 24, 2000, http://www.secureshredders.com/ss/partssupplies/oil/index.html#oil/.

Quill Catalog, p. 1172, upon information and belief, available at least as early as Sep. 2000.

Ideal Operating Instructions. MBM Corporation/IDEAL.MBM Corporation [retrieved on Feb. 22, 2005]. Retrieved from Internet: http://www.mbmcorp.com/pdfs/zo_0106.pdf.

MBM Corporation/IDEAL.MBM Corporation. "*Destroyit*" Shredders 2400 series model Specification Sheet—Sheet Capacity Specification, http://www.mbmcorp.com/pdfs/br_0271.pdf, 2006.

Lewis, Richard J., Sr. (2002). Hawley's Condensed Chemical Dictionary (14th Edition). John Wiley & Sons.

Machine translation from http:babelfish.altavista.com for DE3426979, 1986.

Amendment dated Oct. 31, 2006 cited in U.S. Appl. No. 10/925,470.

Examiner Interview Summary dated Oct. 19, 2006 cited in U.S. Appl. No. 10/925,470.

Examiner Interview Summary dated Nov. 29, 2005 cited in U.S. Appl. No. 10/925,470.

Office Action dated Aug. 7, 2006 cited in U.S. Appl. No. 10/925,470.

Reply Brief filed Apr. 17, 2009 cited in U.S. Appl. No. 90/008,820.

Examiner's Answer to Appeal Brief dated Apr. 2, 2009 cited in U.S. Appl. No. 90/008,820.

Supplemental Appeal Brief filed Nov. 10, 2008 cited in U.S. Appl. No. 90/008,820.

Reexam Preceeding Advisory Action dated Aug. 15, 2008 cited in U.S. Appl. No. 90/008,820.

Reexam Response to Final Office Action filed Aug. 13, 2008 cited in U.S. Appl. No. 90/008,820.

Reexam Preceeding Advisory Action dated Jul. 30, 2008 cited in U.S. Appl. No. 90/008,820.

Reexam Response to Final Office Action filed Jul. 23, 2008 cited in U.S. Appl. No. 90/008,820.

Examiner's Interview Summary dated Jul. 2, 2008 cited in U.S. Appl. No. 90/008,820.

Reexam Final Office Action dated Jul. 2, 2008 cited in U.S. Appl. No. 90/008,820.

Reexam Response to Final Office Action filed Jun. 20, 2008 cited in U.S. Appl. No. 90/008,820.

Reexam Non-Final Office Action dated May 22, 2008 cited in U.S. Appl. No. 90/008,820.

Reexam Determination Ordered dated Oct. 3, 2007 cited in U.S. Appl. No. 90/008,820.

Request for Ex Parte Reexam dated Aug. 27, 2007 cited in U.S. Appl. No. 90/008,820.

* cited by examiner

DELIVERY OF AGENTS TO THE CUTTING MECHANISM OF PAPER SHREDDERS

CROSS-REFERENCE TO RELATED APPLICATIONS

This application is a continuation-in-part of U.S. patent application Ser. No. 10/925,470 filed Aug. 25, 2004, now U.S. Pat. No. 7,166,561 which claims the benefit of U.S. Provisional Patent Application Ser. No. 60/514,154 filed Oct. 23, 2003. This application also claims the benefit of U.S. Provisional Patent Application 60/759,733 filed Jan. 18, 2006. The contents of each of these three patent applications are hereby incorporated by reference herein.

BACKGROUND OF THE INVENTION

1. The Field of the Invention

The present invention relates to the maintenance of paper shredders. More specifically, the present invention relates to delivery of lubricants and other agents to cutting mechanisms of paper shredders.

2. The Relevant Technology

In today's corporate world it is becoming increasingly popular to dispose of important business documents through paper shredding. The paper shredders come in various shapes and sizes, but they all have a similar goal; to shred important documents to protect privacy and business transactions and protect corporate know how.

To effectively shred documents, paper shredders require periodic maintenance and lubrication. Shredders are typically taken apart and oiled via a spray solution or liquid dispenser, which is problematic in several ways. Many owners and users of paper shredders fail to properly maintain and lubricate their machines because of the difficulty and inconvenience involved. This can lead to failure of the shredder and the expense of purchasing a new shredder. Those who do maintain their shredders often must hire service personnel to complete this task. When owners or users of paper shredders personally dissemble and lubricate their shredders, they can be exposed to messy and potentially hazardous oils and inhalation of sprays. Moreover, inconsistent lubrication by consumers has resulted in injury as a result of lubricant combustion. Thus, while paper shredders are common in many homes and businesses, there is a need to improve the manner in which the paper shredders are maintained and serviced. There is also a need to improve the manner in which documents are destroyed by paper shredders so as to increase protection of information from unauthorized access.

BRIEF SUMMARY OF THE INVENTION

Several embodiments disclosed herein relate to the maintenance of shredders, such as, but not limited to, paper shredders, using a substrate that is treated or carries a lubricant and can be fed through the shredding mechanism of a shredder. The use of lubrication sheets greatly simplifies the process of maintaining and lubricating shredders. Rather than requiring disassembly of the shredder, maintenance and lubrication can be performed by passing a lubrication sheet through the shredding mechanism. This process requires no specialized mechanical or maintenance skill other than knowledge of how to operate a shredder. Moreover, lubrication sheets are much cleaner than the lubricants or sprays that have been conventionally used after a shredder has been disassembled.

The lubrication sheets can take any of a variety of forms. For example, the lubrication sheet can be an oil-impregnated tissue or other material that is encased in a cellophane or plastic envelope. The lubrication can include oil, powdered or other forms of dry lubricant, and lubricating gel, for example. According to another embodiment, the lubrication sheet can have an array of small diameter tubes filled with oil. In another implementation of the invention, the lubrication substrate includes a bubble sheet containing oil in the bubbles.

In any of these embodiments, the lubrication substrate can be passed through a shredder in a manner similar to inserting, for example, an ordinary sheet of paper into the shredder. The blades of the shredder engage and disintegrate the lubrication substrate, which releases the lubricant, thereby lubricating the blades. This technique for lubricating the shredder blades can be performed without dissembling the shredder.

In general, the lubrication sheets can be any structure that carries a lubricant and can be passed through the shredding mechanism of a shredder to deliver the lubricant to the blades of the shredder. This technique for lubricating and maintaining shredders significantly reduces the cost and effort that has been required in conventional lubrication methods.

According to another configuration, the lubrication sheet can be scented or capable of releasing a fragrance before, during, and/or after the lubrication sheet passes through the shredder.

In another aspect, the lubrication sheet forms part of a shredder system that tracks the usage of a shredder and notifies a user of the shredder to use the lubrication sheet. The shredder system can include a shredder having a mechanism for tracking the usage of the shredder and a sensor to identify when the shredder receives the lubrication system. The lubrication sheet can include a notification structure or mechanism detectable by the sensor. Optionally, the shredder can include a locking mechanism that prevents use of the shredder until it receives the lubrication sheet.

In still another configuration, the shredder includes a selectable, removable lubricant reservoir that contains lubricant for the shredder's cutting structures or blades. Lubricant from the reservoir is selectively delivered to the cutting structures of blades over time and optionally based upon the quantity of material shredded by the shredder.

A method for preventing disclosure of information printed on a document is disclosed. The method includes applying a decomposition agent to a cutting mechanism of a paper shredder. The method further includes shredding the document using the cutting mechanism of the paper shredder, wherein the decomposition agent is selected to decompose the material of the document and/or ink printed on the document.

These and other objects and features of the present invention will become more fully apparent from the following description and appended claims, or may be learned by practicing the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Figure 1:
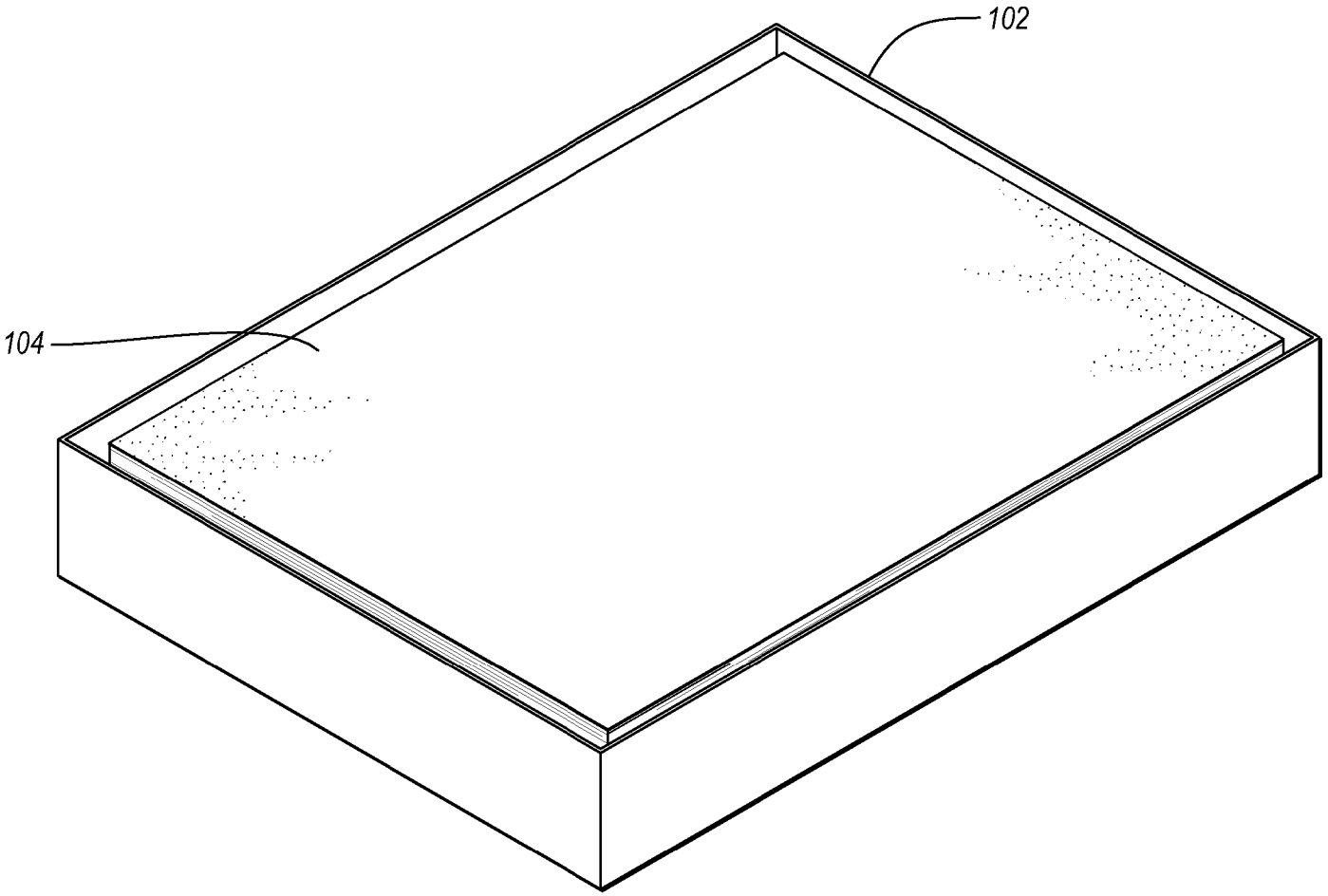
FIG. 1 illustrates a group of corrugated tissue papers that are impregnated with oil for lubricating a paper shredder.

Several embodiments disclosed herein relate to the maintenance of paper shredders using a substrate that is treated or carries an agent and can be fed through the shredding mechanism of a paper shredder to deliver the agent to the shredding elements of the paper shredder. The devices that are used in this manner are referred to herein as "sheets," and "lubrication sheets" interchangeably, and various examples thereof are disclosed in this document. As such, use of the word "lubrication" is not limited to lubricants, but can further include, or consist of, decomposition agents and/or any other agents for delivery to a shredding mechanism of a paper shredder. The decomposition agents may act as cleaning agents and may act in conjunction with the lubricant or independent of the lubricant. According to some embodiments, the use of lubrication sheets that deliver lubricants to shredding elements of paper shredders greatly simplifies the process of maintaining and lubricating paper shredders. Rather than requiring disassembly of the paper shredder, maintenance and lubrication can be performed by passing a lubrication sheet through the shredding mechanism. This process requires no specialized mechanical or maintenance skill other than knowledge of how to operate a paper shredder. Moreover, lubrication sheets are much cleaner than the lubricants or sprays that have been conventionally used after a paper shredder has been disassembled.

While the following discussion of several embodiments will be directed generally to the use of substrates for carrying and releasing a lubricant to the blades of a paper shredder, the principles of the invention can also be applied to the delivery of other substances into a paper shredder or other type of shredder. As such, the term "lubrication sheet" refers to any type of structure or sheet-type material that can pass through a shredder and aid with delivery of an agent to the shredding elements of a paper shredder. Thus, the lubrication sheets can facilitate delivery of lubricating agents and/or decomposition agents, as well as any combination and relative amounts of other lubricating, cleaning, and maintenance agents, to the shredding elements of a shredder.

For example, several embodiments relate to delivery sheets for delivery of one or more decomposition agents to the shredding elements of a paper shredder. According to these embodiments, a decomposition agent may aid in and help facilitate decomposition of debris, such as paper, in the shredding elements thereby cleaning the shredding elements. Moreover, a decomposition element can facilitate decomposition of ink. Decomposition of ink can relate to improved destruction of information recorded on shredded material, such as confidential documents. As such, a decomposition agent can create an additional obstacle to reconstruction of a shredded document and subsequent discovery of information recorded on the shredded document. As such, the ink eating microbes may help provide an additional level of security and protect sensitive data from identity theft.

Several of the embodiments disclosed herein further include means for retaining a measured amount of lubricant, or other agent, in an even distribution across a length and/or width of the lubrication sheet. Moreover, the a mount and type of agents delivered can be manufacturer controlled and selected. For example, referring to FIGS. 1-6, various embodiments of means for retaining an even distribution of a measured amount of lubricant are illustrated. Such means can include structures such as bubbles, tubes, and absorptive substrates as well as other lubrication substrates having properties capable of retaining the even distribution of a measured amount of lubricant. As such, manufacturers of the lubrication sheets may have increased control over the amount of lubrication applied to the cutting mechanisms, as well as the rate at which the lubrication is applied to the cutting mechanisms.

Any portion of the sheets may carry imagery or text. For example, the substrates or the shells may include advertising or instructions. Where the shell carries advertising or instructions, a shell layer may be substantially translucent to allow the advertising or instructions on the substrate to be seen through the shell layer.

Figure 2:
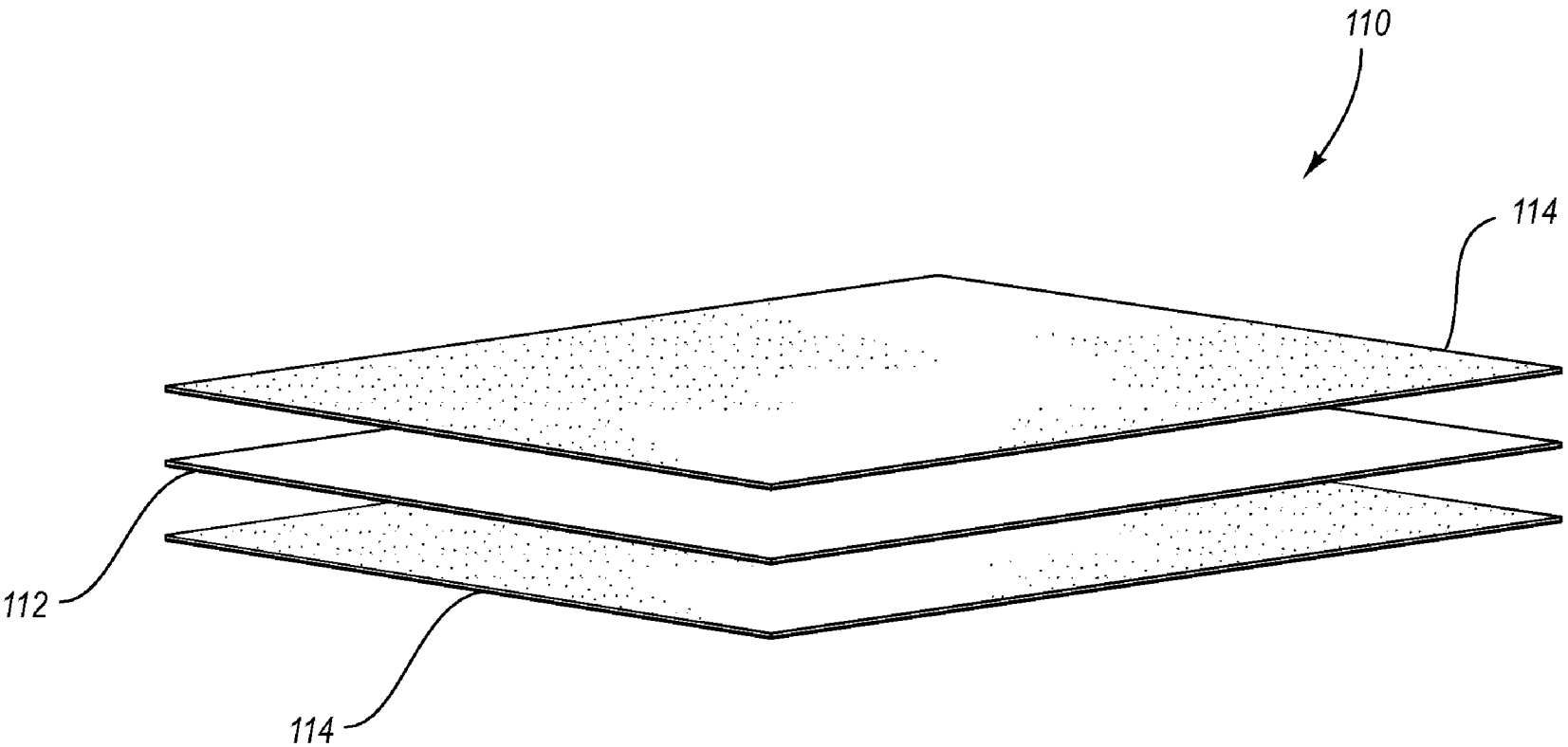
FIG. 2 illustrates a sealed plastic envelope that contains an oil-impregnated layer for lubricating a paper shredder.

FIGS. 1-6 illustrate various embodiments of the lubrication sheets and the methods for maintaining and lubricating paper shredders using the lubrication sheets. The substrates can come in a variety of form factors including corrugated paper, cardboard, waxboard and other materials capable of carrying a lubricant on its surface or capable of being saturated with a measured amount of lubricant. The substrates may or may not be encased by a shell. For example, FIGS. 1 and 2 illustrate an embodiment of a lubrication sheet that includes a shell that encases a substrate that is treated with oil or another lubricant. The shell can be formed from cellophane or from a polymeric, or plastic, material, in which case, the shell is substantially non-penetrable and seals the encased substrate and lubricant, while protecting the user from exposure to any oily substance or lubricant.

The shell of FIGS. 1 and 2 and the other shells disclosed herein include one or more shell layers positioned, respectively, on one or either side of the lubrication sheet. The shell layers can be impermeable to the lubricant or, in other embodiments, can be formed from paper or another material that is not necessarily impermeable to the lubricant. For example, in embodiments, such as those of FIGS. 3-6, in which the lubricant is encased by the structure of the lubricant sheet, the user can be protected from exposure to the lubricant without requiring an impermeable shell layer.

In some embodiments, the shell layers can provide mechanical stiffness and/or rigidity to the lubrication sheets, which can be useful in facilitating the act of passing the lubrication sheet through the shredding mechanism. The lubrication substrate can also provide a mechanical stiffness and/or rigidity to the lubrication sheets in any of the embodiments disclosed herein. Thus, any portion of any structure disclosed herein, such as any portion of the shell layer(s) and/or lubrication substrate(s), can provide mechanical stiffness and/or rigidity. Moreover, additional structures can be implemented to provide stiffness and/or rigidity to the lubrication sheets. Such stiffness and/or rigidity attributes can improve cleaning, lubrication, and/or removal of debris from cutting elements of paper shredders. However, the substrate and shell layers or other portions of the embodiments may or may not be mechanically stiff or rigid. For example, in several embodiments implementing scented agents, the sheet may or may not be stiff or rigid or even carry other agents than the scented agent, such as lubrication or decomposition agents.

The shell layers and/or the substrates can also be substantially brittle and have a shear strength and stiffness characteristic that promotes rupture instead of stretching, thinning, and clogging of the cutting mechanism. For example, at least a portion of a shell layer and/or a substrate in any of the embodiments disclosed herein can be substantially brittle. These characteristics have been found to facilitate pushing debris out of the shredding mechanism of paper shredders thereby improving the cleaning of the shredding mechanism.

Retaining an even distribution of a measured amount of lubricant, or other agent, across a lubrication sheet has been discovered to render many advantages. For example, retaining an even distribution of a measured amount of lubricant across a lubrication sheet can improve consistent lubrication of shredding mechanisms as well as consistent removal of debris resulting in additional cleaning of the shredding mechanisms.

In addition, retaining an even distribution of a measured amount of lubricant, or other agent, across a lubrication sheet can have safety implications. For example, it has been discovered that uneven distribution of lubrication can result in combustion of lubrication or otherwise dangerous situations. As such, it has become of increased importance for manufacturers to control the amount of lubricant delivered and to ensure consistent and even distribution of lubrication, or other agents. These many benefits, as well as others, are discussed in further detail hereinafter, and can be realized and understood by referring to the drawings and by practicing the various embodiments of the invention.

FIG. 1 illustrates a cellophane enclosure 102 that encases a stack of light corrugated tissue papers 104, or other at least partially corrugated material capable of retaining lubricant, that are encased with a lubricant. Prior to use, the tissue papers 104 can be stored in the cellophane enclosure 102. At the time that one of the tissue papers 104 is to be applied to the shredding mechanism of a paper shredder, the tissue paper is removed from the cellophane enclosure 102 and is fed into the paper shredder. FIG. 1 is an example of a stack of individual substrates that are stored in a protective enclosure prior to use.

The individual lubrication sheets can be removed from a carrier and shred. Such embodiments can include a tab for protection of the user from coming into contact with the agents. Individual sheets can carry catchy office jokes, positive thoughts, marketing, or educational instructions which may be reviewed by the end user prior to shredding of the sheet.

FIG. 2 illustrates an exploded view of a sheet 110 having a single substrate 112 that is sealed in an envelope 114 that is formed from a plastic or polymeric material or another oil-impervious material to prevent the lubricant from leaving the substrate prior to shredding. The substrates 104 of FIG. 1 and the substrates 112 of FIG. 2 can be available in various thickness (e.g., $1/16^{th}$ inch, $1/8^{th}$ inch, $1/4^{th}$ inch) and sizes, which can be selected to correspond to the feed and shredding mechanisms of any paper shredder. The substrate can include or consist of paper, Teflon® or another fluoropolymer resin, or another suitable substrate that can carry the lubricant, and be passed through and shredded by the shredding mechanism of the paper shredder. The person performing maintenance places the lubrication sheet 110 into the paper shredder. As the shredder pulls in and shreds the plastic casing 114, the lubricant coats the blades of the shredding mechanism and effectively oils the shredder without the need to dismantle the device. Moreover, certain substrates, such as fluoropolymer resins and other materials, can also operate as lubricants and partially coat the blades of the shredding mechanism when the lubricant sheet is shredded. Packages of multiple lubrication sheets can be sold to owners of paper shredders, thereby enabling paper shredders to be lubricated immediately whenever the need arises.

Figure 3:
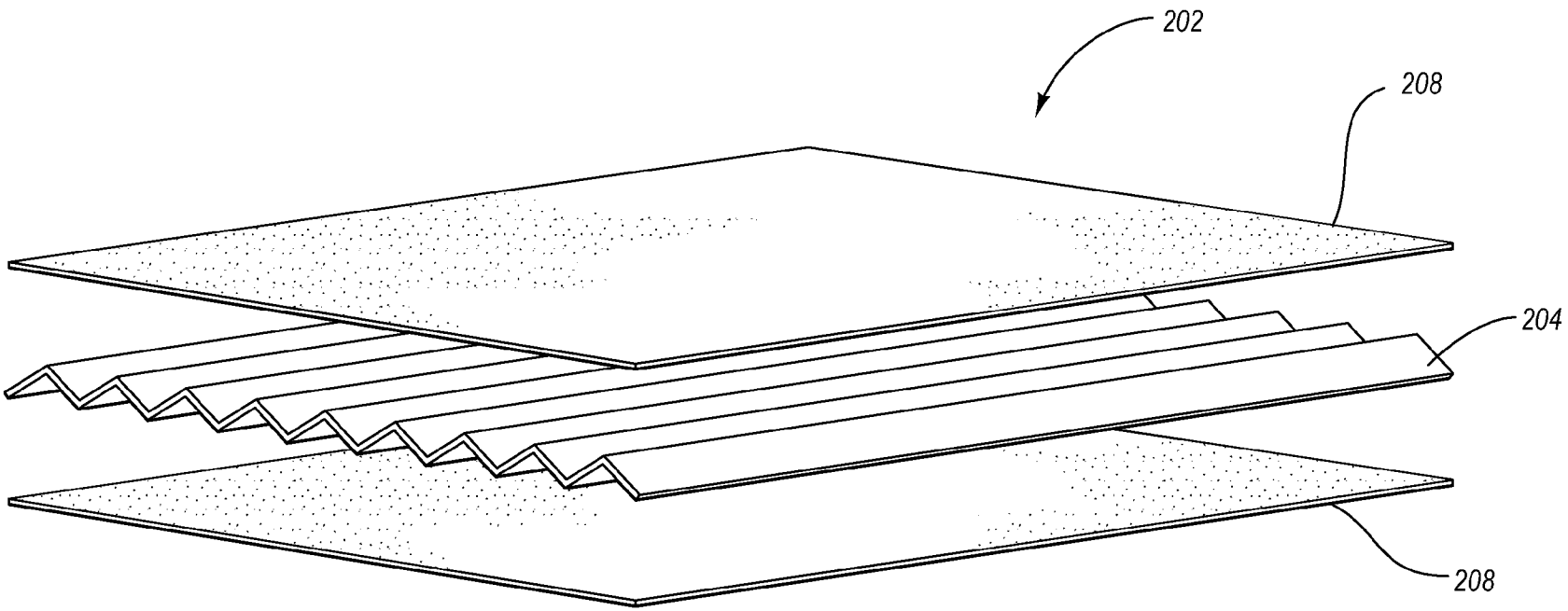
FIGS. 3 and 4 depict a lubrication substrate with an array of small diameter tubes filled with oil for lubricating a paper shredder.
Figure 4:
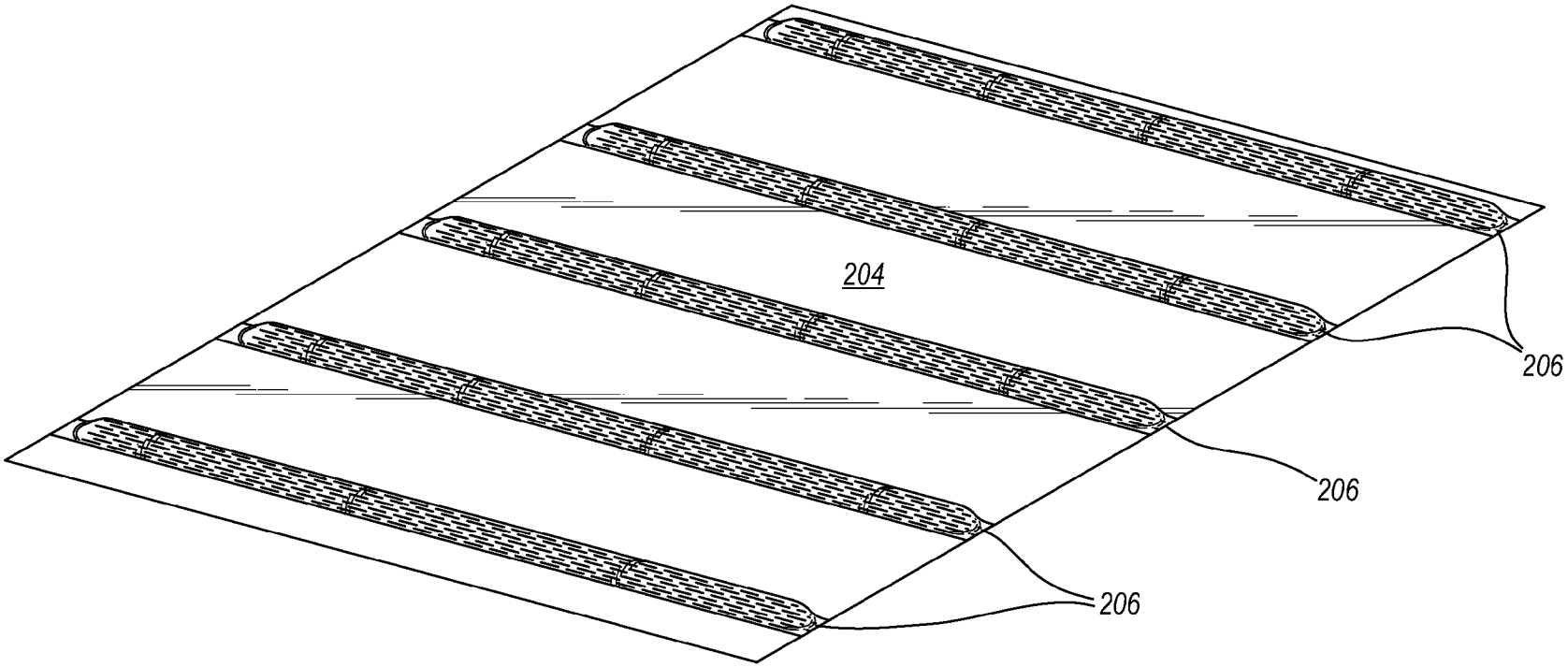

FIGS. 3 and 4 illustrate another embodiment that is similar in many aspects to the lubrication sheets of FIGS. 1 and 2. The lubrication sheet 202 of FIGS. 3 and 4 has a lubrication substrate 204 with an array of small diameter tubes 206 filled with a lubricant or other agent. As shown in the exploded view of FIG. 3, the lubrication substrate 204 can be encased in an envelope 208. The lubrication substrate 204 carries the small diameter tubes 206 rather than being directly impregnated with oil. The tubes 206 can take a variety of forms. For example, the tubes 206 can be integrally formed on, inherent, or integrated within substrate 204 or can be formed separately and attached thereto during the process of manufacturing the lubrication sheets 202. The tubes 206 can be separate structures or can be formed from a single tubular structure that extends back and forth over the substrate 204 or any combination thereof The methods for using the lubrication substrates 204 of FIGS. 3 and 4 are essentially the same as those described elsewhere herein. However, the tubes 206 further isolate the lubricant from the user and the environment prior to the substrate 204 being passed through the paper shredder. Corrugation of the lubrication substrate or the casing can also add rigidity and/or stiffness to the lubrication sheet according to any of the embodiments illustrated herein. The tubes 206 can also have different agents in particular tubes for delivery of agents in stages.

Figure 5:
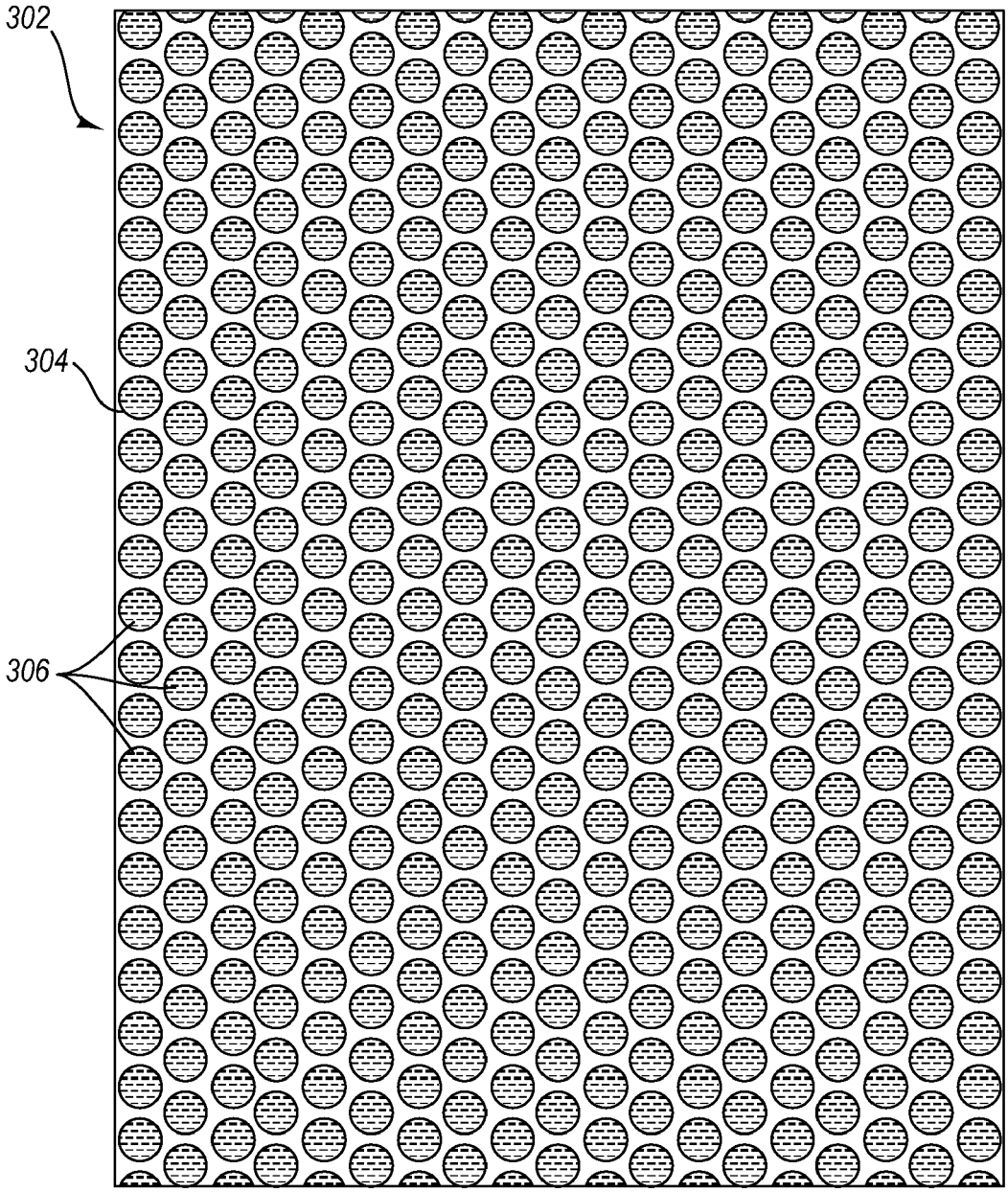
FIGS. 5 and 6 illustrate a lubrication substrate formed from a bubble sheet that contains oil for lubricating a paper shredder.
Figure 6:
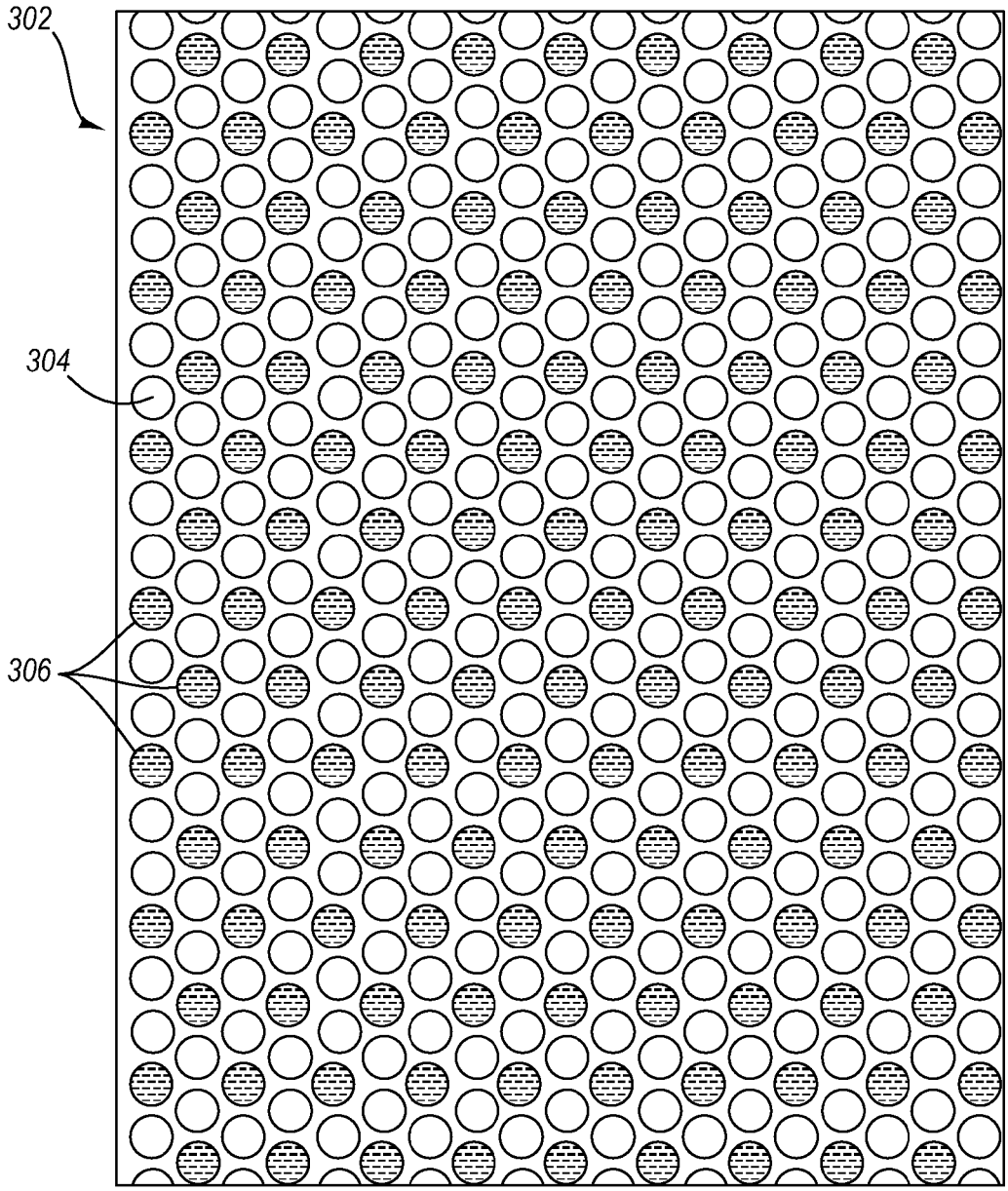

FIGS. 5 and 6 illustrate another embodiment of the lubrication sheets of the invention. This embodiment includes a lubrication substrate 302 in the form of a bubble sheet 304 having a structure similar to conventional bubble wraps that are used for packaging. The bubble sheet 304 can include an at least two dimensional array of bubbles as shown in FIGS. 5 and 6. The bubble sheet 304 is adapted for use in the maintenance and lubrication of paper shredders by filling some, or all, of the individual bubbles 306 with the lubricant and/or any combination of agents or other material. For example, the bubbles 306 can contain lubricant, decomposition agents or other cleaning agents, and/or scented oil or other scented agent. The bubble sheet 304 effectively encases the lubricant until the lubrication sheet 302 is passed through the shredding mechanism. The lubrication sheet 302 can include only the bubble sheet 304 and the associated lubricant, or can instead also include other layers on one or either side of the bubble sheet layer, such as paper, tissue, cellophane, plastic, a fluoropolymer resin, etc., or other material impervious to the agent. It can be appreciated from FIGS. 5 and 6 that the bubbles illustrate one of several examples disclosed herein for retaining an even distribution of a measured amount of lubricant across the lubrication sheet 302. Moreover, any of the teachings of the various embodiments disclosed herein can be implemented together in any combination or permutation, and to any extent. The lubricant usable for the lubrication sheets of the present invention can have various configurations so long as the lubricant will lubricate the cutting structures of the shredder.

Figure 7:
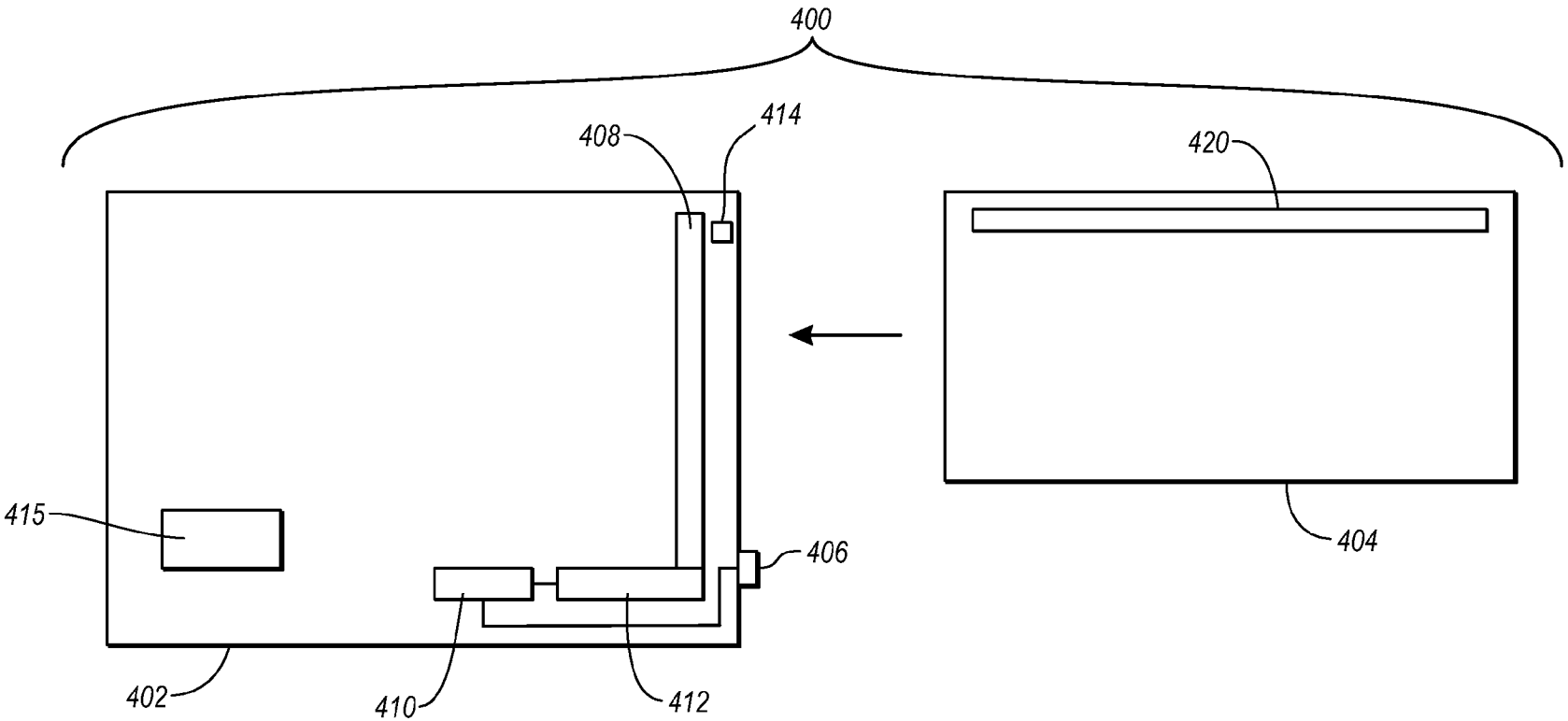
FIG. 7 illustrates a shredder system where a shredder tracks the quantity of material shredded by the shredder.

Turning to FIG. 7, illustrated schematically is a shredder system 400 according to another configuration of the present invention. The shredder system 400 has many of the features, characteristics and functions of the lubrication sheets described herein. As such, any description of the lubrication sheets contained herein also applies to the shredder system 400.

Shredder system 400 can include a shredder 402 and a lubrication sheet 404 usable to lubricate the shredder 402. It will be understood, however, that the shredder system 400 can also include just the shredder 402 without the lubrication sheet 404. To notify a user when to lubricate the shredder 402, an indicator 406 is mounted to the shredder 402 in such a location to be viewable by the user. As shown in FIG. 7, the indicator 406 can include a light emitting diode (LED) or a light bulb that is illuminated when it is time to lubricate the cutting structures 408, such as cutting blades, of the shredder 402. In another configuration, the indicator 406 can be included in a liquid crystal display (LCD) of the shredder 402, i.e., lighting of the LCD and/or displaying text that notifies the user that it is time to lubricate the shredder 402. The indicator 406 can include a counter that may display the words "Lubricate Now" when lubrication is determined to be needed. The indicator 406 may also indicate a scale of use of the shredder. For example, the indicator 406 may indicate a number of sheets shredded or a number of sheets remaining until lubrication is needed. The scale may be represented by text, numbers, imagery, or other means. The indicator 406 can be manually or automatically resetable.

To selectively illuminate the indicator 406, the shredder 402 can include a mechanism 410 that tracks the quantity of material passed through the shredder 402 and/or the time since the last lubrication sheet 404 passed through the shredder 402. This mechanism 410 can include a counter, a timer, or other means for tracking usage of the shredder 402. For instance, the mechanism 410 can be a microcomputer, computer, circuitry, microchip, electromechanical device, combination thereof, or other means that can perform the function of tracking the quantity of material passing through the shredder. The mechanism 410 can include a sensor for tracking the number of sheets received by the shredder 402. For example, light sensor, such as an interrupt optical sensor or a reflective optical sensor. As such, the sensor can sense the present and absence of a sheet of paper thereby tracking the number of sheets of paper received. The sensor can also include different wavelengths of light and some wavelengths of light may penetrate the shredded material thereby giving an indication of the thickness and/or density of the shredded material, for example indicating the number of sheets of paper shredded at one time.

When a defined quantity or time has been attained, the indicator 406 upon the shredder 402 can be illuminated, for example as a flashing LED, to show that lubrication should occur. When the lubrication sheet 404 has been received by the shredder 402, the indicator 406 can be reset, darkened and/or turned off Optionally, the mechanism 410 can activate a locking mechanism 412 that prevents the continued usage of the shredder 402 until the shredder 402 receives the lubrication sheet 404. For instance, the locking mechanism 412 can include a physical locking structure, such as a pin, brake, or other structure to prevent movement of the cutting blades 408. In another configuration, the locking mechanism 412 limits current flow to the motor (not shown) that moves the cutting blades. In still another configuration, the locking mechanism 412 utilizes electromechanical devices, microcomputers, computer, microchips, circuitry, software, combinations thereof, and/or other structures and methods to prevent continued shredding until the shredder 402 receives the lubrication sheet 404.

To identify when the shredder 402 receives the lubrication sheet 404 and to reset, darken, and/or turn off the indicator 406, the shredder 402 can include a sensor 414. This sensor 414 can track the material shredded by the shredder 402 and identify the receipt of the lubrication sheet 404. To aid with this tracking functionality, the lubrication sheet 404 includes a notification structure or mechanism 420 that can be sensed by the sensor 414. For example, the notification structure or mechanism 420 can include any type of indicia, structure, signal, and other means for identification of the lubrication sheet 404. For instance, when the lubrication sheet 404 includes a means for associating a signal with the lubrication sheet 404, such as a magnetic strip-type notification structure 420, the sensor 414 can detect the strip 420, for example based on a magnetic signal, and deactivate or reset the indicator 406 and/or the locking mechanism 412. Other signal generating means can be implemented such as electromagnetic (such as a radio-frequency identification chip) or electromechanical signal generating means. Similarly, when the lubrication sheet 404 includes an optical indicia, such as a colored strip-type notification structure 420, the sensor 414 can detect the strip 420 and deactivate or reset the indicator 406 and/or the locking mechanism 412. Further, when the lubrication sheet 404 includes a structural indicia, such as a raised notification structure 420, i.e., a portion of the lubrication sheet that has a surface above the surface of the remainder of the lubrication sheet, the sensor 414 can detect the raised notification structure 420 and deactivate or reset the indicator 406 and/or the locking mechanism 412.

The lubrication sheet 404 can also include an electrically charged portion that may be detected by the sensor 414. For example, the lubricant or other portion of the sheet 404 can include a slight electrical charge that would be sensed by the sensor 414 and reset the indicator 406 and/or locking mechanism 412. A foil linking or other portion of the sheet 404 can carry an electrical charge to be sensed by the sensor 414 and reset the indicator 406 and/or locking mechanism.

An agent or reaction can also create the electrical charge. An agent can be released when the sheet 404 is shredded. This agent can react with a component of the sheet 404 and create an electrical charge that may be detected by the sensor 414. For example, copper, tin foil, and vinegar when mixed create a modest electrical current when they interact. Any combination of agents can be employed to react when combined (i.e. when the sheet 404 is shredded) for any purpose, such as to identify the sheet, promote cleaning, promote lubrication, and/or promote safety.

According to some embodiments, the sensor 414 can be an optical sensor, magnetic sensor, mechanical sensor, electromechanical or electromagnetic sensor, combinations thereof, or other sensor that can identify when the lubrication sheet 404 is received by the shredder 402. So long as the sensor 414 is compatible with the notification structure or mechanism of the lubrication sheet 404, any type of sensor can be used.

The paper shredder can include a control apparatus. The control apparatus is configured to perform an associated shredding procedure when the sensor identifies the sheet carrying the agent. The associated shredding procedure can include reversing the shredding mechanism for a predetermined time period after the sheet carrying the agent has been shredded. The associated shredding procedure can include reversing the shredding mechanism at various rates. For example, the shredding mechanism can be reversed for about 10 seconds after the sheet carrying the agent has been shredded.

In general, the lubrication sheet 404 can be any structure that carries a lubricant and can be passed through the shredding mechanism of a paper shredder to deliver the lubricant to the blades of the paper shredder. This technique for lubricating and maintaining paper shredders significantly reduces the cost and effort that has been required in conventional lubrication methods. The invention extends to both the lubrication and other substrates described herein and to the methods of using the substrates as they are passed through the shredding mechanism of a paper shredder.

Figure 8:
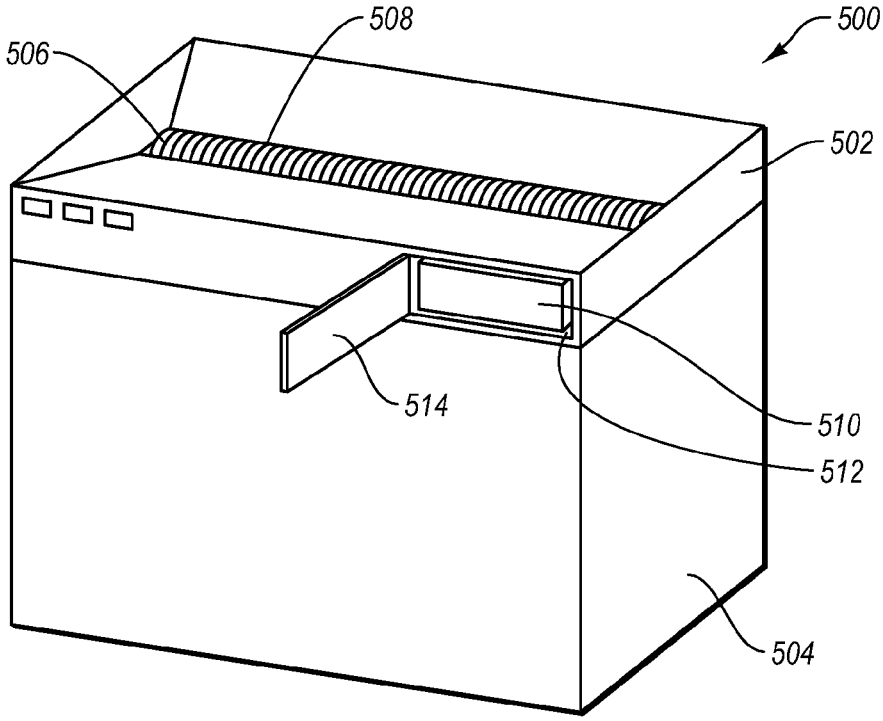
FIG. 8 illustrates a shredder system having a selectively removable lubricant reservoir.

Turning to FIG. 8, another shredder system 500 is illustrated according to the present invention. The shredder system 500 can include a shredder portion 502 and a collection portion 504. The shredder portion 502 can be optionally and selectively mountable to the collection portion 504, which functions as the container or receptacle to collect the shredded material. It will be understood, however, that shredder portion 502 can be integrally formed with the collection portion 504, with the collection portion 504 including an access door or mechanism to access the shredded material.

With continued reference to FIG. 8, the shredder portion 502 is configured to shred material inserted into a recess 506 in the shredder portion 502. To shred the material, disposed within the recess 506 are one or more blades 508. These blades 508 rotate to cut the material into small pieces and/or strips. Optionally, the shredder portion 502 can include one or more additional blades (not shown) that move transverse to the direction by which material is inserted into the recess 506. These one or more additional blades can cut the material into small pieces.

To lubricate the one or more blades 508, and the optional one or more additional blades (not shown), the shredder system 500 can include a lubrication reservoir 510. This reservoir 510 can be selectively mountable to any portion of the shredder system 500, such as, but not limited to, the shredder portion 502 of the shredder system 500. The reservoir 510 can be selectively removable and/or disposable. The reservoir 510 can store lubricant and/or a decomposition agent and may be somewhat akin to a disposable ink jet cartridge used in the printing industry, for example. The reservoir 510 may or may not be replenishable by an end user. In the exemplary configuration of FIG. 8, the reservoir 510 is selectively mountable to (and removable from) a bay 512 formed in the shredder portion 502. An optional door 514 can be used to aid with maintaining the reservoir 510 within the shredder portion 502. It will be understood, however, that the engagement between the reservoir 510 and the bay 512 may be sufficient to maintain the reservoir 510 within the bay 512 without the door 514.

Figure 9:
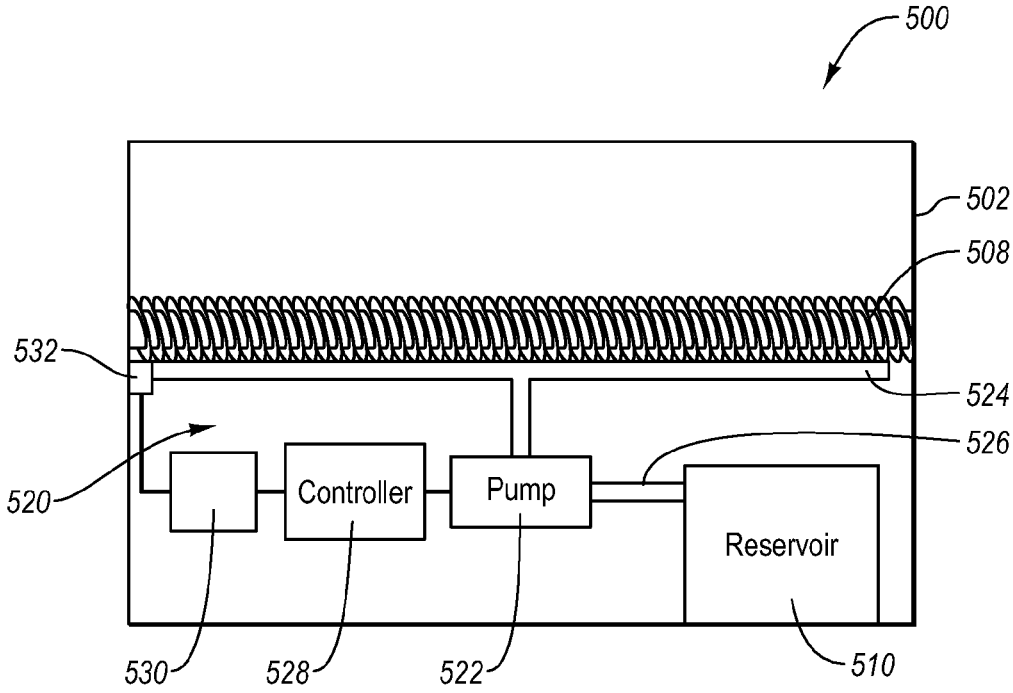
FIG. 9 illustrates a schematic representation of a portion of the shredder system of FIG. 8.

When the reservoir 510 is mounted to the shredder portion 502 of the shredder system 500, the lubricant contained within the reservoir 510 is in communication (e.g. fluid communication) with a delivery mechanism 520, as shown in FIG. 9. This delivery mechanism 520 delivers the lubricant to the one or more blades 508 so that they become lubricated and function more effectively than if no lubrication were applied. The delivery mechanism 520 can include one or more of a pump 522, a distribution member 524, an inlet conduit 526, and a controller 528.

In the example configuration illustrated in FIGS. 8 and 9, the pump 522, such as a hydraulic, electric, or other pump, draws the lubricant from the reservoir 510 along the inlet conduit 526, such as a length of tubing or other structure capable of performing the function of enabling a lubricant to travel from the reservoir 510 to the pump 522, or other device that causes the lubricant to be delivered to the blades 508. The inlet conduit 526, at the end opposite to that mounted to the pump 522, selectively mounts to the reservoir 510, either directly or indirectly. It will be understood that, in some configurations, the lubricant can be delivered to the blades 508 without the use of the pump 522. For instance, the lubricant can be delivered due to gravity feed, capillary feed, or other technique known to those skilled in the art to deliver a fluid from one location to another. The pump can also be a manual pump, for example a push-button pump, where actuation of the pump is enabled by a user of the shredding device. For example, there can be a series of small orifices and a tube which runs along the length of the blades 508. When the pump 522 is operated, e.g. turned on or manually actuated, lubricant is pushed to the blades 508.

Upon receiving the lubricant, the pump 522 forces the lubricant into the distribution member 524, which in turn delivers the lubricant to the blades 508. The lubricant can flow from a plurality of holes (not shown) adjacent or in close proximity to the blades 508 to lubricate the blades 508. The flow rate and operation of the pump 522 can be controlled by a controller 528. The distribution member 524 can have various configurations, such as tubing or other materials that function to enable a lubricant to travel from the pump 522 to the blades 508. Further, the distribution member 524 need not have a plurality of holes, but have a structure that allows the lubricant to wick or be discharged without the need for a hole.

In addition to the above, the controller 528 can indicate to a user of the shredder system 500, such as by one or more lights, indicia, or other mechanisms, that there is a low level of lubricant in the reservoir 510 or that it is time to lubricate the blades 508. Various types of controllers 528 are known to those skilled in the art. For instance, and not by way of limitation, the controller 528 can include one or more microprocessors, micro-controllers, electromechanical devices, or other structures capable of performing the function of controller the delivery of a lubricant to one or more blades.

According to another configuration, the controller 528 can cooperate with a counter 530, and associated sensor 532, such as a motion sensor or sensor that can track or sense rotational motion of the blades 508. This can be based on a number of rotations of the blades 508, an amount of paper shredded, or an amount of time that the blades 508 have rotated. In this manner, the controller 528 can activate the pump 522 to deliver lubricant upon the counter 530 identifying that a predetermined quantity of material has been shredded by the shredder system 500, for example. For instance, the sensor 532 can deliver signals indicative of the number of rotations of the blades 508 to the counter 530, which in turn delivers a count of the rotations. The controller 528 can receive the signal and determine whether the desired number of rotations has been attained. When the desired number of rotations has been attained, the controller 528 can activate the pump 522 to deliver the lubricant. Alternatively, the counter 530 can deliver a signal to the controller 528 that indicates that the desired number of rotations has been attained; again resulting in the controller 528 activating the pump 522 to deliver the lubricant.

Various types of counters 530 are known to those skilled in the art. For instance, and not by way of limitation, the counter 530 can include one or more microprocessors, micro-controllers, electromechanical devices, or other structures capable of performing the function of the counter. Further, various types of sensors 532 are known to those skilled in the art. For instance, and not by way of limitation, the sensor 532 can include one or more optical sensors, magnetic sensors, electronic sensors, or other structures capable of performing the function of identifying the motion of the blades.

The principles of the invention can also be applied to the delivery of other substances into any shredder. For example, the lubrication sheets and lubrication reservoirs disclosed herein can be adapted to carry a substance that facilitates the destruction or decomposition of paper and/or ink (hereinafter "decomposition agent"). The decomposition agent can be carried by the substrates and reservoirs either with or without the lubricant. In addition, the decomposition agent can be carried by substrates, reservoirs, and/or shredding devices having the structures illustrated and otherwise described herein, or that have other structures that will be understood by those of skill in the art upon learning of the inventive concepts disclosed herein.

In one embodiment, the decomposition agent includes microbes that facilitate the decomposition of paper. The microbes can be those that have conventionally been used at toxic waste sites or can be other microbes suitable for enhancing the decomposition of paper.

The decomposition agents and methods for delivering them to paper in a paper shredder as described herein are useful to further prevent unauthorized individuals from gaining access to information written on papers that have been shredded. Thus, the use of the decomposition agents in combination with the physical shredding of paper in a paper shredder can effectively prevent unauthorized individuals from obtaining any useful information from the paper that has been processed by the shredder and the decomposition agent. For example, the decomposition agents may assist in the decomposition of both paper and ink. Moreover, the decomposition agent can be selected so as to decompose ink in particular, or paper in particular. As such, reconstruction and discovery of information recorded on a shredded document can be further inhibited.

The decomposition agents can also be delivered directly to the shredded material and may or may not bypass the shredding mechanism of the paper shredder. For example, as shredded material passes the shredding mechanism it may come into contact with decomposition agent that is fed, for example using a pump or capillary action, to the shredded material. This may enhance destruction of the confidential information carried by the shredded material.

In several configurations, a portion of the sheet can be scented or capable of releasing a fragrance before, during, and/or after the lubrication sheet passes through the shredder. To provide the scent or fragrance, the substrate and/or the lubricant can include a scented agent or be capable of releasing a fragrance. In this manner, the lubrication sheet not only lubricates the shredder's cutting blades, but adds a scent or fragrance to the area surrounding the shredder. The scent or fragrant released by shredding of the sheet can be pleasing to a human and generate a scent reminiscent of the smell of a plant, such as fruit and flowers, or other scents typically employed in conventional air fresheners.

The scented sheets may or may not include other agents than the scented agent. Therefore, the scented sheets may or may not include lubricating and/or decomposition agents. In some embodiments, the shredder may be considered a tool for distributing and releasing aroma via the aromatherapy sheets. However, the delivery of scented oil may also include the benefit of cleaning and/or lubricating the shredder.

Figure 10:
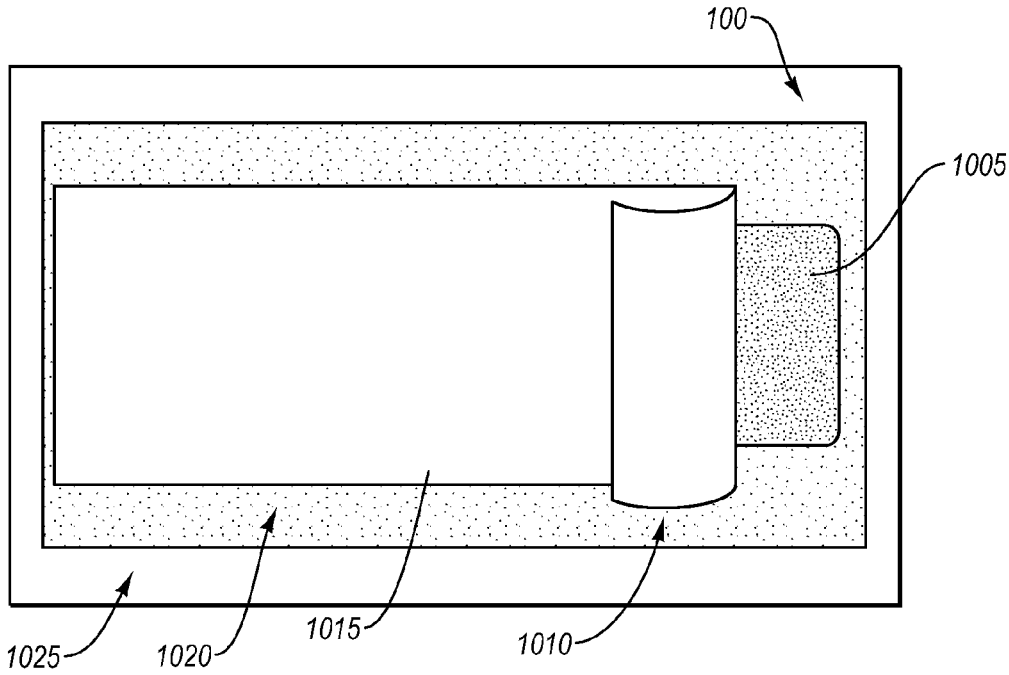
FIGS. 10 and 11 illustrate a sheet for carrying a scented agent.
Figure 11:
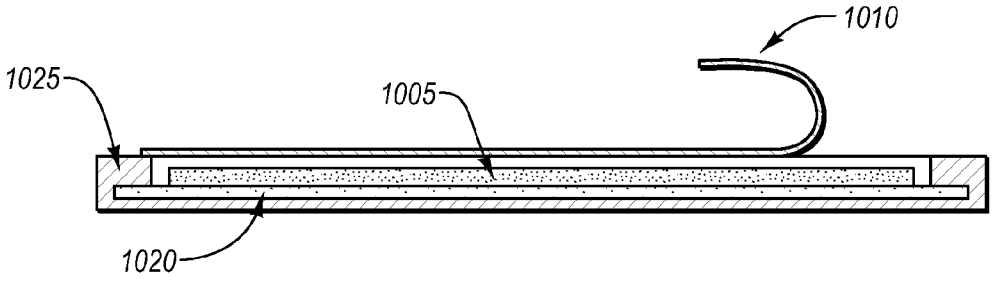

For example, referring to FIGS. 10 and 11, a sheet 1000 carrying a scented agent is illustrated. The scented agent, such as a scented oil or other agent capable of dispersing a fragrance, is carried by a substrate 1005. The sheet 1000 can include a tab 1010 for peeling back a shell layer 1015 thereby exposing the substrate 1005 carrying the scented agent. When release of the fragrance is no longer desired, the tab 1010 may be pulled in the opposite direction resealing the shell layer 1015 and preventing release of the fragrance by the scented agent. Therefore, once the fragrance is no longer released by the scented agent the sheet 1000 can be discarded in any manner.

The substrate 1005 may or may not also carry a lubrication agent and/or a decomposition agent; or the scented and lubrication and decomposition agents may constitute the same agent. Referring again to FIG. 10, the sheet 1000 can include a second substrate 1020 carrying a lubrication and/or decomposition agent. The second substrate 1020 can be any of the various embodiments disclosed herein. However, the second substrate 1020 may be combined with the substrate 1005 carrying the scented agent to apply a lubricant to the shredding mechanism of a paper shredder. The second substrate 1020 can be encased within an oil impermeable barrier 1025, such as the shell layers discussed above. As such, the sheet can be placed in a room and the tab 1010 retracted thereby releasing the fragrance of the scented agent carried by substrate 1005. Once the scented agent no longer releases the fragrance, the sheet 1000 can be shredded thereby lubricating the shredding mechanism of the paper shredder. The substrates 1005 and 1020 can be embodied by a single substrate carrying any combination of the various agents discussed herein in any relative amounts for generating a fragrance, lubrication and cleaning of the shredding mechanism, and/or for decomposing paper and ink of shredded documents or debris carried by the shredding mechanism. The scented agent can include designer perfumes or essential oils typically used in aromatherapy.

A paper shredder may also include mechanisms for dispersing fragrance. For example, referring again to FIG. 7, the paper shredder 402 can include a fan 415 and a porous or mesh container (not shown, e.g. see 504 in FIG. 8) for receiving shredded material. Thus, after a substrate 404 carrying a scented agent is shredded by the paper shredder 402 the fan 415 can circulate air over the shredded substrate thereby enhancing disbursement of the fragrance generated by the scented agent. The fan 415 can also be associated with the sensor 414 such that the fan 415 is turned on upon sensing that the sheet 404 containing the scented agent is received by the paper shredder 402. The sheets 404 may have different signals, structures, or mechanisms to identify the sheet 404 as a sheet carrying a particular type of agent or combination of agents. For example, the sensor 414 may identify the sheet 404 as carrying a scented agent thereby turning on the fan 415. The sensor 414 may also identify the sheet 404 as carrying only a lubrication or decomposition agent, and as a result, not turn on the fan 415 in this instance.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A sheet for delivery of an agent to a shredding mechanism of a paper shredder comprising:

a substrate that is configured to be passed through the shredding mechanism of the paper shredder;

a lubricating agent carried by the substrate; and one or more shell layers adjacent to the substrate, wherein the one or more shell layers provide mechanical stiffness and/or rigidity to the sheet in addition to any stiffness and/or rigidity provided by the substrate by itself in order to help maintain the sheet in a more rigid configuration compared to the substrate by itself and thereby facilitate passing the sheet through a shredding mechanism of a paper shredder.

2. A sheet according to claim 1, wherein the stiffness and/or rigidity provided by the one or more shell layers facilitates cleaning of cutting elements of a paper shredder.

3. A sheet according to claim 1, further comprising a decomposition agent and/or a scented agent on the substrate.

4. A sheet for delivering an agent to a shredding mechanism of a paper shredder, comprising:

a substrate that is configured to be passed through the shredding mechanism of the paper shredder;

a lubricating agent carried by the substrate; and one or more shell layers adjacent to the substrate, wherein the one or more shell layers provide greater mechanical stiffness and/or rigidity to the sheet than the substrate by itself, wherein the sheet has a stiffness and/or rigidity so as to facilitate cleaning, lubrication, and removal of debris from cutting elements of a paper shredder.

5. A sheet according to claim 4, wherein the substrate also contributes mechanical stiffness and/or rigidity to the sheet.

6. A sheet according to claim 4, wherein the one or more shell layers are impervious to the lubricating agent.

7. A sheet according to claim 4, further comprising a decomposition agent and/or a scented agent on the substrate.

8. A sheet for delivering a lubricating agent to a shredding mechanism of a paper shredder, comprising:

a first layer that is configured to be passed through the shredding mechanism of the paper shredder;

a second layer that is configured to be passed through the shredding mechanism of the paper shredder adjacent to the first layer; and a lubricating agent carried between the first and second layers, wherein the first and second layers define a cavity there between within which only the lubricating agent is carried, wherein the cavity spans a width of the sheet between which the first and second lavers are sealed to one another at the edges of the sheet, and wherein the first and second layers have a stiffness and/or rigidity so as to facilitate passing the sheet through a shredding mechanism of a paper shredder and retain an even distribution of the lubricating agent across a length and width of the sheet.

9. A sheet according to claim 8, further comprising a third layer adjacent to one of the first or second layers and having a stiffness and/or rigidity as to remain planar in order to facilitate passing the sheet through a shredding mechanism of a paper shredder.

10. A sheet according to claim 8, wherein the first and second layers provide mechanical stiffness and rigidity to the sheet in order to facilitate removal of debris from cutting elements of a paper shredder.

11. A sheet according to claim 8, wherein the first and second layers provide mechanical stiffness and rigidity to the sheet in order to facilitate cleaning of cutting elements of a paper shredder.

12. A sheet according to claim 9, further comprising a decomposition agent and/or a scented agent between the third layer and one of the first or second layers.

13. A sheet for dispersing a scented agent, comprising:

a substrate that is configured to be passed through the shredding mechanism of the paper shredder;

a scented agent carried by the substrate, the scented agent being capable of releasing a fragrance; and a second substrate separated by a barrier from the substrate carrying the scented agent, wherein the second substrate carries a lubrication and/or decomposition agent.

14. A sheet according to claim 13, wherein the fragrance is released only after the sheet is passed through the shredding mechanism.

15. A sheet according to claim 13, wherein the substrate carries a lubrication agent and/or a decomposition agent.

16. A sheet according to claim 13, further comprising a tab, wherein the tab is releasably attached to the substrate so as to allow selective release of the fragrance upon at least partial removal of the tab.

17. A sheet for delivery of an agent to a shredding mechanism of a paper shredder comprising:

a substrate that is configured to be passed through the shredding mechanism of the paper shredder;

a lubricating agent carried by the substrate; and one or more shell layers adjacent to the substrate, wherein the substrate and/or the one or more shell layers have a shear strength and stiffness that promotes rupture of the sheet instead of stretching, thinning and/or clogging of a cutting mechanism of a paper shredder when passed therethrough.

18. A sheet according to claim 1, wherein the one or more shell layers have a mechanical stiffness and rigidity so as to remain planar and facilitate insertion of the sheet into an elongated slot of a paper shredder and retain an even distribution of lubricating agent across the sheet.

19. A sheet according to claim 1, wherein the one or more shell layers have a shear strength and stiffness that promotes rupture of the sheet instead of stretching, thinning and/or clogging of a cutting mechanism of a paper shredder when passed therethrough.

20. A sheet according to claim 1, wherein the stiffness and/or rigidity provided by the one or more shell layers facilitates removal of debris from cutting elements of a paper shredder.

21. A sheet according to claim 4, wherein the sheet has a mechanical stiffness and rigidity so as to remain planar and facilitate insertion of the sheet into an elongated slot of a paper shredder and retain an even distribution of lubricating agent across the sheet.

22. A sheet according to claim 4, wherein the sheet has a shear strength and stiffness that promotes rupture of the sheet instead of stretching, thinning and/or clogging of a cutting mechanism of a paper shredder when passed therethrough.

23. A sheet according to claim 4, wherein the stiffness and/or rigidity of the sheet facilitates pushing debris out of a shredding mechanism of a paper shredder.

24. A sheet according to claim 8, wherein the first and second layers have a mechanical stiffness and rigidity so as to remain planar and facilitate insertion of the sheet into an elongated slot of a paper shredder.

25. A sheet according to claim 8, wherein the first and second layers have a shear strength and stiffness that promotes rupture of the sheet instead of stretching, thinning and/or clogging of a cutting mechanism of a paper shredder when passed therethrough.

26. A sheet according to claim 8, wherein the stiffness and/or rigidity of the first and second layers facilitates pushing debris out of a shredding mechanism of a paper shredder.

27. A sheet according to claim 8, wherein the first and/or second layer carries imagery or text comprised of advertising and/or instructions for using the sheet.

28. A sheet for delivering a lubricating agent to a shredding mechanism of a paper shredder, comprising:

a first layer configured to be passed through the shredding mechanism of the paper shredder;

a second layer configured to be passed through the shredding mechanism of the paper shredder; and a lubricating agent carried between the first and second layers, wherein the first and second layers have a stiffness and/or rigidity so as to remain planar in order to facilitate passing the sheet through an elongated slot and into a shredding mechanism of a paper shredder, wherein the sheet includes a total of two layers, and wherein the first and second layers define a cavity there between within which only the lubricating agent is carried, wherein the cavity spans a width of the sheet between which the first and second layers are sealed to one another at the edges of the sheet, and wherein the first and second layers are sealed to one another only at the edges of the sheet.

29. A sheet according to claim 28, wherein the first and second layers have a mechanical stiffness and rigidity so as to:

remain planar and facilitate insertion of the sheet into an elongated slot of a paper shredder and retain an even distribution of lubricating agent across the sheet, and/or facilitate removal of debris from cutting elements of a paper shredder, and/or facilitate cleaning of cutting elements of a paper shredder.

30. A sheet according to claim 28, wherein the first and second layers have a shear strength and stiffness that promotes rupture of the sheet instead of stretching, thinning and/or clogging of a cutting mechanism of a paper shredder when passed therethrough.

31. A sheet for delivering a lubricating agent to a shredding mechanism of a paper shredder, comprising:

a first shell layer configured to be passed through the shredding mechanism of the paper shredder;

a second shell layer configured to be passed through the shredding mechanism of the paper shredder; and a lubricating agent carried between the first and second shell layers, wherein the first and second shell layers have a stiffness and/or rigidity so as to remain planar in order to facilitate passing the sheet through an elongated slot and into a shredding mechanism of a paper shredder, wherein the first and second shell layers have a shear strength and stiffness that promotes rupture of the sheet instead of stretching, thinning and/or clogging of a cutting mechanism of a paper shredder when passed therethrough, and wherein the first and second shell layers have a stiffness and/or rigidity that facilitates cleaning and/or removal of debris from cutting elements of a paper shredder wherein the first and second shell layers define a cavity there between within which only the lubricating agent is carried, wherein the cavity spans a width of the sheet between which the first and second shell layers are sealed to one another at the edges of the sheet.

32. A sheet for delivery of an agent to a shredding mechanism of a paper shredder comprising:

a substrate that is configured to be passed through the shredding mechanism of the paper shredder;

a lubricating agent carried by the substrate; and one or more shell layers adjacent to the substrate, wherein the one or more shell layers provide greater stiffness and rigidity to the sheet than the substrate by itself and a stiffness and/or rigidity so as to remain planar when positioned adjacent to the substrate in order to facilitate passing the sheet through an elongated slot and into a shredding mechanism of a paper shredder.

* * * * *

US007902129C1

(12) INTER PARTES REEXAMINATION CERTIFICATE (838th)

United States Patent

Allen

(10) Number: US 7,902,129 C1

(45) Certificate Issued: *Mar. 7, 2014

(54) DELIVERY OF AGENTS TO THE CUTTING MECHANISM OF PAPER SHREDDERS

(75) Inventor: Mark S. Allen, Orem, UT (US)

(73) Assignee: Buttercup Legacy, LLC, Orem, UT (US)

Reexamination Request:
No. 95/001,705, Sep. 12, 2011

Reexamination Certificate for:

| | |
|---|---|
| Patent No.: | **7,902,129** |
| Issued: | **Mar. 8, 2011** |
| Appl. No.: | **11/563,616** |
| Filed: | **Nov. 27, 2006** |

( * ) Notice: This patent is subject to a terminal disclaimer.

Related U.S. Application Data

(63) Continuation-in-part of application No. 10/925,470, filed on Aug. 25, 2004, now Pat. No. 7,166,561.

(60) Provisional application No. 60/514,154, filed on Oct. 23, 2003, provisional application No. 60/759,733, filed on Jan. 18, 2006.

(51) Int. Cl.

| | |
|---|---|
| ***C10M 109/00*** | (2006.01) |
| ***F01M 9/00*** | (2006.01) |
| ***B02C 18/00*** | (2006.01) |
| ***B65D 77/00*** | (2006.01) |

(52) U.S. Cl.
USPC ..... 508/110; 508/100; 184/109; 241/2; 241/15

(58) Field of Classification Search
None
See application file for complete search history.

(56) References Cited

To view the complete listing of prior art documents cited during the proceeding for Reexamination Control Number 95/001,705, please refer to the USPTO's public Patent Application Information Retrieval (PAIR) system under the Display References tab.

*Primary Examiner* — Russell Stormer

(57) ABSTRACT

Lubrication substrates are disclosed that have been treated with or that carry a lubricant for maintaining a paper shredder. The lubrication substrate is fed through the shredding mechanism of a paper shredder. Rather than requiring disassembly of the paper shredder, maintenance and lubrication can be performed by passing the lubrication substrate through the shredding mechanism. The lubrication substrates can take any of a variety of forms, and can be substantially rigid and/or stiff. The lubrication substrates can also include scented lubricants and decomposing agents. Paper shredders are also disclosed for use with the lubrication substrates. The paper shredders can have various means for identifying when lubrication is needed and/or when the cutting mechanism of the paper shredder is lubricated by a lubrication sheet. Paper shredders having a reservoir of lubricant for delivery to the cutting mechanism of the paper shredder are also disclosed.

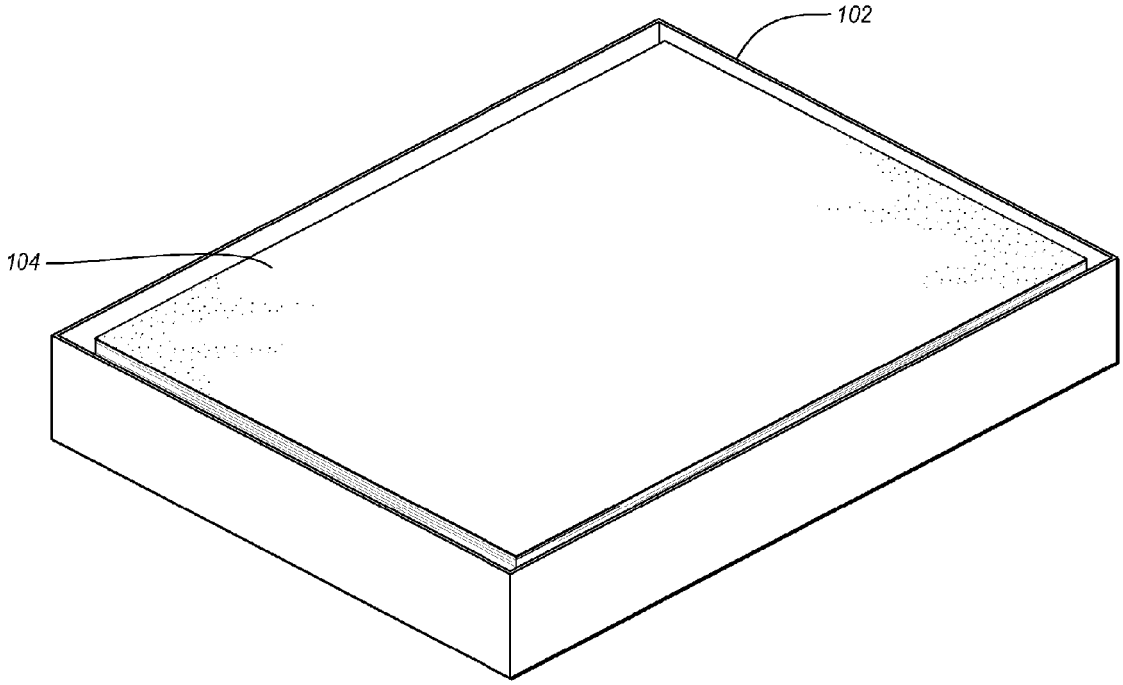

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1, 4, 8, 17, 28, 31 and 32 are cancelled.

Claims 2, 3, 5-7, 9-16, 18-27, 29 and 30 were not reexamined.

* * * * *